United States Patent [19]

Grenia

[11] 4,174,135

[45] Nov. 13, 1979

[54] UNDERGROUND FORMED WALL SINGLE-ENTRY MINING METHOD

[75] Inventor: James D. Grenia, Concord, Calif.

[73] Assignee: Bechtel International Corporation, San Francisco, Calif.

[21] Appl. No.: 894,668

[22] Filed: Apr. 10, 1978

[51] Int. Cl.[2] ..... E21C 41/00

[52] U.S. Cl. ..... 299/11

[58] Field of Search ..... 299/11

[56] References Cited

U.S. PATENT DOCUMENTS

| | | | |
|---|---|---|---|
| 2,846,205 | 8/1958 | Bucky | 299/11 |
| 3,527,500 | 9/1970 | Thompson | 299/11 |
| 4,007,966 | 2/1977 | Wenneborg | 299/11 |

*Primary Examiner*—Ernest R. Purser

*Attorney, Agent, or Firm*—Bertram I. Rowland

[57] ABSTRACT

A method is provided for the underground mining of thin seams of certain minerals, such as coal, particularly minerals capable of being bored or cut, employing walls formed in place. A relatively narrow substantially rectangular drift is cut in the seam, usually the entire height of the ore formation. The drift is then filled with low-grade concrete to form a wall. After the concrete has set to have sufficient compressive strength to provide support for the overburden, additional drifts are driven immediately adjacent to the wall and are joined behind the wall, so as to allow for air circulation around the wall and provide space to repeat the process. In this way, a plurality of tandem walls can be introduced through the working area of the seam. Between each tandem wall, a temporary barrier is erected, having manways with closeable doors therein as required, so that forced ventilation will travel the full length of one drift and return back through the companion drift.

Additional walls may be established at lateral distances from the first wall, so as to define an area of the seam for longwall mining. Desirably, the walls are of a compressible material. After removal of the mineral or coal between the walls, upon subsidence of the overburden, the walls will be substantially compacted, so as to minimize surface unevenness.

18 Claims, 3 Drawing Figures

UNDERGROUND FORMED WALL SINGLE-ENTRY MINING METHOD

BACKGROUND OF THE INVENTION

1. Field of the Invention

In mining minerals and coal in underground tunnels, it is necessary to insure that there is no subsidence over the area until it has been mined so as to permit safe and effective mining of the area. There has, therefore, been a number of different ways to provide support for the over-burden to allow for substantial removal of the material being mined. Frequently, support has been obtained by leaving a significant portion of the mined material as a support means, in addition to having timbers and steel to provide additional support.

The above techniques are both inefficient and expensive. The mineral which is used for support is lost to recovery. The lumber and steel required is of relatively high cost and requires substantial labor to be installed initially and then is only partially recovered for reuse. It is therefore desirable to find new techniques which would allow for efficient removal of more of the material being mined and minimize the use of costly supporting materials.

2. Brief Description of the Prior Art

A technique referred to as the British Packwall concept is taught, where a wide drift is initially formed and a packwall introduced in the middle of the drift to provide support. In this concept, a relatively wide drift (such as 20–30 feet) is driven into a seam and provided with the necessary steel and/or wood roof and side supports. Forms for a concrete wall are then placed in the middle of the drift and filled with concrete. After hardening of the concrete, the forms for the wall and related drift roof supports are removed, with the concrete wall now forming the necessary support. British Pat. No. 1,043,687 teaches a method of mining coal in steep measures involving an upper and lower road, forming a plurality of steep drifts from the upper to the lower road, providing for load supporting concrete pillars to occupy the drifts, and then mining the mineral standing between the pillars. U.S. Pat. No. 3,892,442 teaches the use of a foam to fill mine cavities, to control roof fall and earth subsidence.

SUMMARY OF THE INVENTION

Underground mining of thin mineral seams is provided employing walls formed in place, where a transverse drift of relatively small dimensions is driven and then filled with low grade concrete which on setting provides a support wall. Drifts are then driven on both sides of the support wall and to the rear of the wall to join the side drifts, so that air can circulate completely around the wall. The drift to the rear of the wall is employed to repeat the process, so other tandem or aligned supporting walls extend along the same line substantially the entire working area. Temporary barriers are built between the concrete walls, at the rear or end of each of said walls on the same line, so that air may circulate through the entire length of one drift and return through the entire length of the other drift.

To expedite mining, a substantially parallel wall is built in the seam in the same manner a distance away from the first wall, so that an area for mining is defined between the two walls. The rear-most faces are joined by a drift to form an access. Mining of the mineral between the two walls may then be initiated from the access. The process may be repeated as many times as is desired until the available seam has been mined.

BRIEF DESCRIPTION OF THE DRAWINGS

In the figures, various parts have been exaggerated in size or dimensions for clarity of illustration and ease of description. Also, like reference numerals are used to denote like or similar parts.

DESCRIPTION OF THE SPECIFIC EMBODIMENTS

Figure 1:
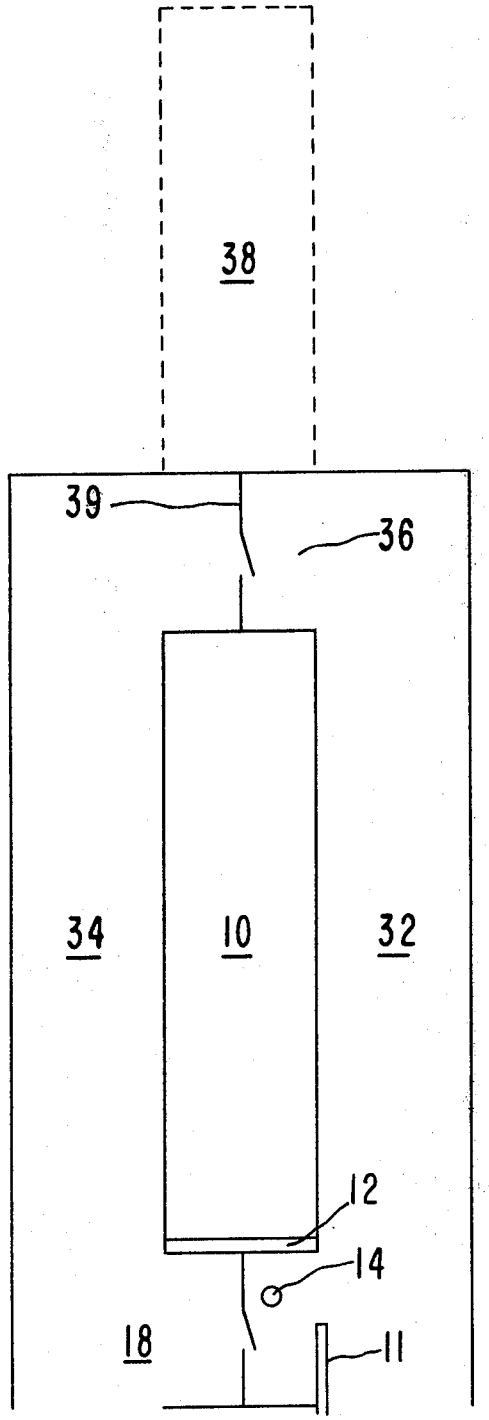
FIG. 1 is a plan diagrammatic view of the method of forming the wall.

The subject invention provides a novel, efficient and economical method for the mining of various minerals which occur in relatively thin seams. Any material which can be cut or similarily mined, can be mined in accordance with the subject technique. These minerals include coal, salt, potash, trona and the like. Seams which can be mined in accordance with the subject technique will generally be of a height in the range of about 3½ feet to 12 feet. Thinner seams are generally not economical to mine and substantially thicker seams will generally be mined in alternative manners.

In general terms, a relatively narrow drift, usually about the height of the seam, is driven transversely into a seam. The drift should be sufficiently narrow so as to provide its own roof and side supports, although it may be desirable to have additional ancillary support to insure the safety of men and machines working in the drift. Timbers may be used or roofs may be bolted by conventional means to provide the ancillary supports. The drift will be about 10 feet wide and may extend as far as 600 feet into the seam, usually being from about 300 to 500 feet in length, but it may be longer than 600 feet if adequate ventilation can be provided. The material mined during the tunneling operation may be removed by shuttle cars or a continuous belt or other means. Ventilation is afforded by conventional means, such as a ventilating fan and tubing or brattices, to the working face in the drift.

When the drift has been excavated the desired length, it is then filled with a low grade material, e.g. concrete, generally having a bearing strength equal to or greater than the mineral being mined, such as about 3000 psi for certain types of coal. A partial bulkhead is provided at the back of the drift and filling is begun at the advance end of the drift. The bulkhead is never moved and is raised as the drift is filled to restrain the toe of the concrete. The concrete material may be conveniently brought into the drift by means of a pipe through the overburden or by appropriate pipes in access tunnels. Conveniently, the concrete can employ washing wastes, in combination with cement and tailings, gravel, or other filler material which provides the necessary bearing strength and integrity. The bulkhead is started at the rear or beginning of the drift and is raised as the drift is filled with concrete. About 24 to 48 hours will be required for the concrete to cure sufficiently to allow mining to commence on either side of the concrete wall.

Drifts about 15 to 20 feet in width are then driven on either side of the wall and to the rear of the wall to form a substantially U-shaped tunnel. The drifts on either side, and to the rear, of the concrete packwall will generally be wider than the wall to allow for ducts, pipes, the movement of excavating equipment and removal of the mined material. Particularly, the tunnel to the rear of the wall should be wide enough to allow for the movement of air and equipment and the removal of the mined material around the wall and from other parallel drifts.

The process of forming a wall may now be repeated in the seam as described above, so that a second wall tandem to and continuing along the line of the first wall is formed, with the second wall also having adjacent drifts on each side of the wall. In addition a temporary barrier with adequate roof supports is provided between the first and second wall, with manway access. This barrier is removable, but provides for the circulation of air the full length of the two drifts on each side of the tandem walls, without the air forming sidestreams in the tunnels at the end of each wall. Thus, the ventilation fans can be used to drive air the full length of one drift, behind the furthermost wall, and then have the air return back through the drift on the opposite side of the wall.

In addition to providing a series of tandem walls along a line which give support to the seam, other laterally spaced walls can also be formed which provide a plurality of substantially parallel supporting walls, encompassing the width of the working area. Two parallel walls define a panel or working area and provide support as the panel is mined. Normally, the rearmost areas beyond the walls will be joined to form an accessway, with the panel mined from the rear toward the original access areas.

Support stopping is placed as required in the access areas so that the circulating air moves the length of one drift (the inboard drift) through the rear accessway, and returns through the confronting drift (the outboard drift), on the opposite side of the panel.

The parallel walls will normally be spaced apart laterally from about 500 to 800 feet, more usually from about 600 to 700 feet. As the mineral is being removed, the overburden may subside, so as to fill the space. Desirably, the concrete employed outboard of the panel being mined will then become compacted under the force of the subsidence, so that a substantially smooth ground surface will result.

For further understanding of the invention, the drawings will now be considered.

Turning now to FIG. 1, a drift 10 is cut transversely into a narrow seam, substantially the full height of the seam, but sufficiently narrow to be either self supporting or requiring only minor ancillary beam support. The drift is cut by mining machines in a rectangular shape, but can be of any other shape required by the formation or other physical considerations. The drift is formed by conventional means or by continuous miners, generally being a width of about 10 feet. Backbolting may be accomplished by such means as bolting machines mounted on the excavator or with a roof bolter. The material mined during the tunneling operation is carried from the drift by conventional means, such as by shuttle cars or by a continuous belt. If ground conditions dictate that more support is required than would be provided by a wall having a width of about 10 feet, the width of the wall may be greater initially, may be expanded, or the concrete quality to be used may be improved to gain additional roof support. Ventilating ducts and fans or brattices are provided to insure the continual flow of fresh air in the drift with tubing or brattices extending air to the working face. One or more supply lines 11 may be provided for materials and power lines.

Figure 3:
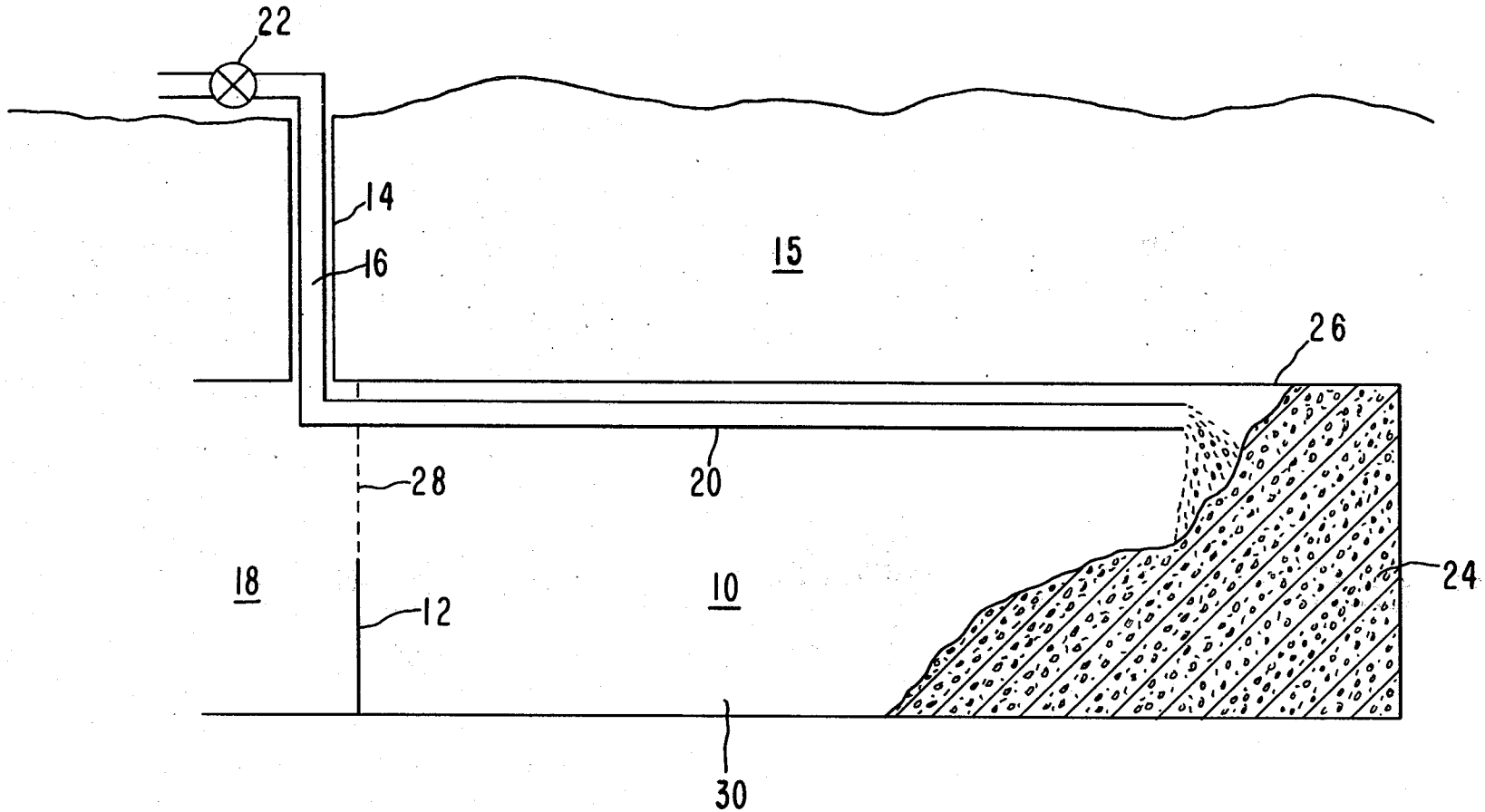
FIG. 3 is a cross-section view of a drift being filled with packwall materials.

The sides, ceiling and floor of the drift provide the forming walls for a packfill concrete wall. A partial bulkhead 12 as depicted in FIG. 3 is built to retain the concrete. To supply the packfill, a concrete supply hole 14 is provided, such as through the overburden 15, or from other sources, through which piping 16 extends through the access area 18 and into the drift 10. The piping is connected to horizontal, fixed or flexible, piping 20 with the piping 20 extending into the drift 10. A pump 22 or air placing device is provided for pumping the concrete into the drift as required, with or without the aid of gravity. The concrete is poured so as to begin to fill the rear of the drift 10 and as the concrete 24 rises to the ceiling 26 of the drift 10, part of the pipe 20 may be dismantled and withdrawn. The filling continues and the bulkhead 12 is raised to the ceiling 26, as depicted by the broken line 28, closing the drift 10, and additional concrete poured through a hole in the bulkhead 12 into the drift 10 until the drift is completely filled with the concrete to form packwall 30.

If ancillary supporting members have been employed in the drift 10, these may be removed sequentially as the drift 10 is filled. In addition, while the packwall 30 is being formed, the tunneling machine may be removed to the next panel excavation area.

When the packwall in drift 10 has cured, usually within 24 to 48 hours, tunneling is begun adjacent each side of the packwall. See FIG. 1. During this mining operation, the packwall is inspected and any voids that may be present are filled before the wall assumes the full weight burden. The two side tunnels 32 and 34 are then joined by rear tunnel 36 so as to form an ventilation loop. The intake air is driven by ventilation equipment up side tunnel 32 and then around and down side tunnel 34. The width of the side tunnels 32 and 34 and the rear tunnel 36 is sufficient to provide for access equipment to build the next tandem packwall 38, as well as to allow for the removal of the mineral from the drifts. In addition, a second concrete supply hole 14c (See FIG. 2) may be drilled from above or concrete is supplied from other sources to provide the concrete for the pack fill for the next wall.

The entire process is now repeated with a second tandem wall 38 formed. A support stopping wall 39 is installed with manway access, so that the ventilation loop can extend the length of the side tunnels 32 and 34. The process of building successive tandem walls is continued until the length of the seam has been bridged.

Figure 2:
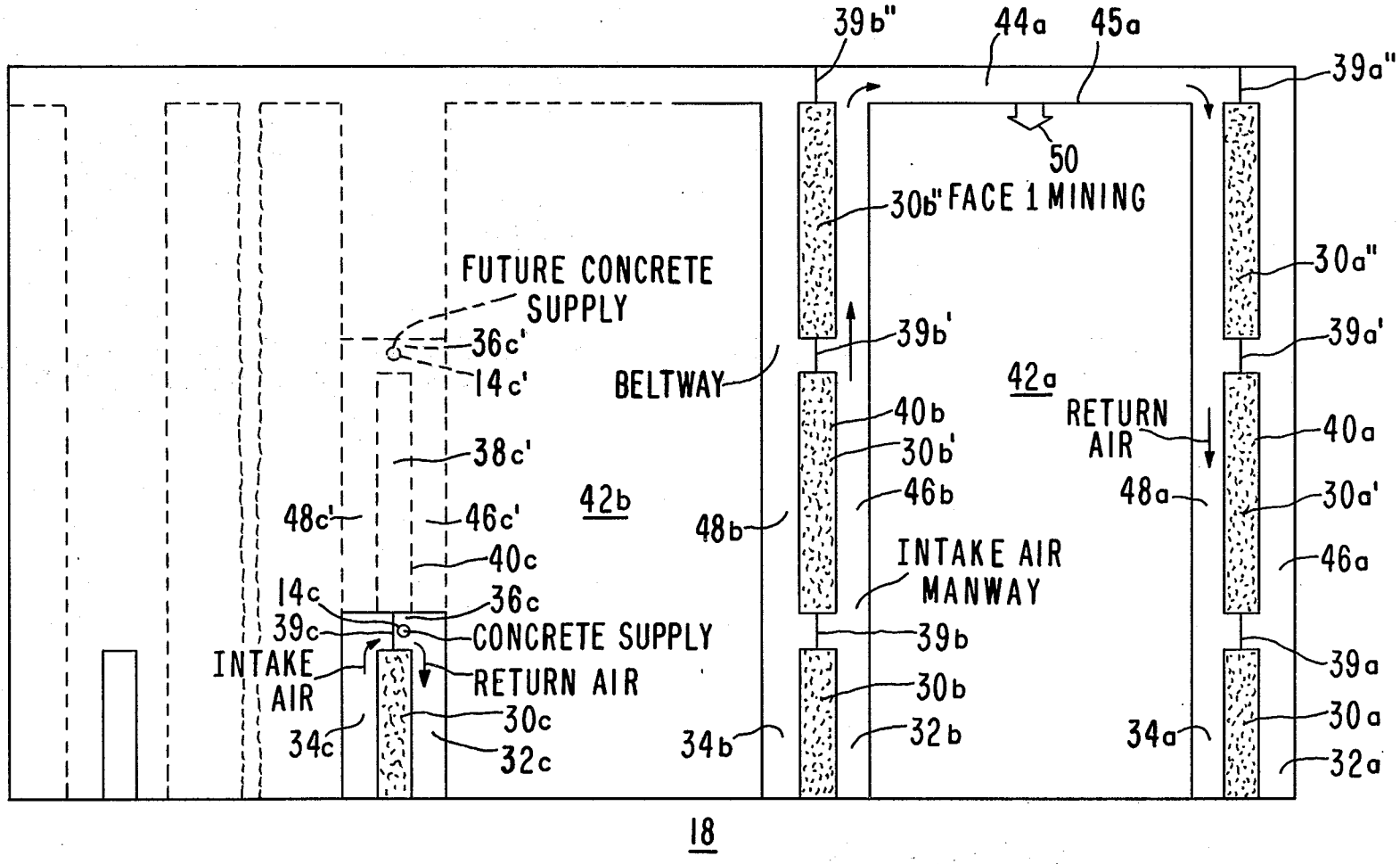
FIG. 2 is a plan diagrammatic view with the walls in place and an additional wall being formed with intermediate ore panels.

Turning now to FIG. 2, and ignoring the letter designations, the above process may also be repeated laterally in the seam to create a plurality of parallel walls with seam panel 42 between the walls. An accessway 44 is then cut roughly perpendicular to the transverse tunnels 46 and 48, connecting them. Mining of the panel 42 may then begin, beginning at the face 45 adjacent the accessway 44 and mining toward the original access area 18.

In FIG. 2, the subject invention is shown in the process of mining a seam, where packwalls have already been placed and a new packwall is in the process of being formed. The packwall and passageway formation is begun from right to left, using the letters a, b and c to indicate the order of formation of the series of tandem walls and primes to indicate successive walls in a particular series.

In the Figure, there is an access area 18 along one face of the seam and two completed tandem packwall series 40*a* and 40*b* are in place, being comprised of packwalls 30*a*, 30*a'* and 30*a''* and 30*b*, 30*b'* and 30*b''* respectively. The two tandem packwall series 40*a* and 40*b* with accessway 44*a* define a panel 42*a* for mining. Passageway 46*a* provides an access area and is formed as part of the formation of the tandem wall series 40*a*, and can serve as a beltway, as can passageway 48*b* for removal of the ore. Passageways 48*a* and 46*b* with accessway 44*a* define a ventilation loop where the air circulates from passageway 46*b*, with support stopping walls 39*a*, 39*a'*, 39*a''*, 39*b*, 39*b'*, 39*b''* preventing the air from circulating through side passageways. Mining is initiated at 45*a* in the direction indicated by arrow 50. While mining is proceeding on panel 42*a*, a third series of tandem walls 40*c* can be begun as previously described in relation to FIGS. 1 and 3.

After completing packwall 30*c*, drift 38*c'* is mined from access area 36*c*. After forming the packwall in drift 38*c'*, passageways 46*c'* and 48*c'* with access area 36*c'* are formed. In addition, a future concrete supply hole can be drilled and the process repeated to form the final tandem wall.

Mining of the panels 42 is performed from the accessway 44 toward the original access area 18, with longwall or other mining machines moving back and forth across the width of each panel 42 until all of the material has been removed. During this time, the side tunnels 46 and 48 associated with each of the packwalls 30 provide access for machines and personnel, as well as providing ventilation loops for the continuous flow of air. The packwalls 30 support the seam and help provide control for the subsidence of the overburden, since by appropriate choice of the packwall material, the packwalls will generally yield and at least partially collapse as the overburden subsides.

The subject invention can be used for a single seam or a plurality of spaced apart overlying seams, so long as the seams are relatively thin.

The subject invention provides many advantages over prior art techniques. The subject method is more efficient and more economical than the conventional "room and pillar" method as well as other methods which have been recently introduced. Substantial savings are achieved by the minimum usage of auxillary supports. Cheap waste materials which will normally be available at the mining site can be used for formation of some of the packwall. By bringing at least a substantial portion of the packwall material downwardly from the surface, gravity can provide a significant portion of the energy for moving the packwall material into position. The subject method removes substantially all of the mineral in the seam being mined, since pillars are not required to be left in the mine to maintain the necessary support. Furthermore, conventional wall forms are not required, and thus need not be installed and then removed, the walls of the drift providing for the necessary containment of the pack-fill material.

The subject method also allows for efficient use of men and equipment. A drift can be driven for the installation of the packwall. Similarily, parallel tandem wall and tunnels may be mined to permit the mining of all panels. Once the packwall has set, the adjacent tunnels thereto can be excavated and the process repeated in tandem so that supporting walls extending the length of the working area of the seam can be so provided. Each packwall with its adjacent tunnels provide access to the next packwall. The extension of the tunnels along the packwall provides access areas for the movement of men and equipment the length of the working area and for withdrawal of the ore. Ventilation loops are also formed using the subject invention which maintain circulating air during the mining.

By having spaces in the essentially continuous walls, ready access between drifts is provided. One or more accessways from one set of drifts to another set through a panel area are also provided as required to mine the entire working area of a seam. Continuous barriers are formed as required to provide support and maintain ventilation loops. The barriers provide a plurality of accessways for easy movement through the seam being mined.

Although the foregoing invention has been described in some detail by way of illustration and example for purposes of clarity of understanding, it will be obvious that certain changes and modifications may be practiced within the scope of appended claims.

What is claimed is:

1. In the underground mining of relatively thin mineral seams, a method for forming at least one supporting wall for supporting the overburden above said seam and providing access areas adjacent said supporting wall for mining said seam and providing ventilation, said method comprising:

providing a first access area adjacent a face of said seam;

from said first access area, driving transverse to said seam at least a portion of the width of said seam a first drift of substantially self-supporting dimensions and about the height of said seam;

substantially filling said first drift with a flowable and cureable wall forming material;

curing said wall forming material to form a first wall; and excavating a tunnel adjacent to and completely about said wall to form a loop with said first access area and provide a second access area behind the rear end of said wall.

2. A method according to claim 1, including the step prior to filling said first drift, of mining a shaft through said overburden from the surface of said overburden into said first access area for providing access for said wall forming material to said first drift.

3. A method according to claim 2, wherein at least one additional supporting wall in tandem to said first wall is provided with adjacent access areas by employing said second access area as said first access area and repeating the process according to claim 1 to provide successive tandem walls.

4. A method according to claim 3, including the additional step of placing a removeable stopping wall intermediate each of successive tandem supporting walls to form a continuous barrier between said adjacent tunnels.

5. A method according to claim 1, wherein said wall forming material is low grade concrete.

6. A method according to claim 1, wherein said mineral is selected from the group consisting of coal, salt, potash and trona.

7. A method according to claim 6, wherein said mineral is coal.

8. A method according to claim 6, wherein said mineral is potash.

9. A method according to claim 6, wherein said mineral is trona.

10. A method according to claim 6, wherein said mineral is salt.

11. In underground mining of a relative thin ore seam of coal having a height in the range of about 3.5 to 12 feet, a method for forming at least one supporting wall for supporting the overburden above said seam and providing access areas adjacent said supporting wall for mining said seam and providing ventilation, said method comprising:

providing a first access area adjacent a face of said seam;

from said first access area, driving transverse to said seam at least a portion of the width of said seam, but not to exceed about 600 feet, a first drift of about 10 feet in width and about the height of said seam;

substantially filling said first drift with low grade material having a compressive strength at least about equal to said coal and capable of compaction after curing and upon subsidence of said overburden;

curing said low grade material for a time sufficient to provide a first wall of sufficient load bearing strength; and excavating a tunnel adjacent to and completely about said wall to form a loop with said first access area and provide a second access area behind the rear end of said wall.

12. A method according to claim 11, wherein at least one additional supporting wall in tandem to said first wall is provided with adjacent access area by employing said second access area as said first access area and repeating the process according to claim 12 to provide successive tandem walls.

13. A method for the underground mining of relatively thin mineral seams of a cutable mineral, wherein a series of transverse laterally spaced apart supporting walls are formed in place, each of said transverse walls having at least one wall with additional walls being in tandem and spaced apart, said method comprising:

providing two laterally spaced apart first access areas;

driving transverse to said seam from said first access areas first drifts at least a portion of the width of said seam of substantially self-supporting dimensions and about the height of said seam;

substantially filling said first drifts with wall forming material to form first walls;

excavating tunnels adjacent to and about said first walls to form loops with said first access areas and to provide second access areas behind the rear end of said walls;

for additional tandem walls, employing each successive said second access areas as said first access areas and repeating the above steps;

placing door containing removeable stopping walls intermediate each of successive tandem supporting walls to form continuous barriers; and excavating an accessway between the last of said second access areas to form a loop between tunnels on opposing sides of a panel to be mined.

14. A method according to claim 13, wherein said mineral is selected from the group consisting of coal, salt, potash and trona.

15. A method according to claim 14, wherein said mineral is coal.

16. A method for the underground mining of relatively thin coal seams of from about 3.5 to 12 feet in height, wherein a series of transverse laterally spaced apart supporting walls are formed in place, each of said transverse walls having at least one wall with additional walls being in tandem and spaced apart, said method comprising:

providing two laterally spaced apart first access areas adjacent a face of said seam;

from said first access areas, driving transverse to said seam at least a portion of the width of said seam, but not to exceed about 600 feet in length, first drifts of about 10 feet in width and about the height of said seam;

substantially filling said first drifts with low grade material having a compressive strength at least about equal to said coal and capable of compaction after curing and upon subsidence of said overburden;

curing said low grade material for a time sufficient to provide first walls of sufficient load bearing strength;

excavating tunnels adjacent to and about said first walls to form loops with said first access areas and to provide second access areas behind the rear ends of said walls;

for additional tandem walls, employing each successive said second access areas as said first access areas and repeating the above steps;

placing door containing removeable stopping walls intermediate each of successive tandem supporting walls to form continuous barriers; and excavating an accessway between the last of said second access areas to form a loop between tunnels on opposing sides of a panel to be mined.

17. A method according to claim 16, including the step of mining said panel from said accessway in the direction toward said first access areas.

18. A method according to claim 16, wherein said low grade material is low grade concrete.

* * * * *